United States Patent [19]

Mueller

[11] 4,289,240

[45] Sep. 15, 1981

[54] FLIP-LOCK RECLOSABLE CARTON

[75] Inventor: David C. Mueller, Neenah, Wis.

[73] Assignee: American Can Company, Greenwich, Conn.

[21] Appl. No.: 80,550

[22] Filed: Oct. 1, 1979

[51] Int. Cl.[3] ..... B65D 5/54; B65D 5/66

[52] U.S. Cl. ..... 206/624; 229/33

[58] Field of Search ..... 206/624, 625, 626, 611, 206/621; 229/33, 45 R

[56] References Cited

U.S. PATENT DOCUMENTS

| | | | |
|---|---|---|---|
| Re. 26,185 | 4/1967 | Henry . | |
| Re. 26,471 | 10/1968 | Meyers . | |
| 1,509,383 | 9/1924 | Walter | 229/33 |
| 2,381,067 | 8/1945 | Lowey | 229/33 |
| 2,692,722 | 10/1954 | Johnson | 229/45 |
| 2,839,236 | 6/1958 | Dunning | 229/33 X |
| 3,040,957 | 6/1962 | Meyers | 229/37 |
| 3,310,223 | 3/1967 | Buttery | 206/624 X |
| 4,150,748 | 4/1979 | Mueller | 206/624 |

*Primary Examiner*—Stephen P. Garbe

*Attorney, Agent, or Firm*—Robert P. Auber; Thomas D. Wilhelm

[57] ABSTRACT

A reclosable carton having a receptacle portion and a cover portion which is adapted to hingedly close and lock onto the receptacle portion. A reinforcing flap is hingedly connected across the top front edge of the receptacle portion of the carton to resist bowing of a partially emptied carton. An extension flap is adhered to the front panel of the carton and splits away from a depending front flap of the cover as the cover of the carton is initially opened by a user. A locking tab is formed by the detachment of a portion of the extension flap which remains hingedly connected to the front flap. The locking tab engages the edges of the void from which it was removed to provide a locking action on reclosure. The locking tab easily disengages with a toggle action upon reopening of the cover.

12 Claims, 8 Drawing Figures

FLIP-LOCK RECLOSABLE CARTON

BACKGROUND OF THE INVENTION

1. Field of the Invention

This invention relates generally to the field of reclosable cartons, and particularly to so-called "flip top" cartons having a hinged cover portion which can be reclosed and held in a reclosed position on a receptacle portion.

2. Description of the Prior Art

A variety of flip-top reclosable cartons are used for packaging a number of different types of products including food products such as crackers or ice cream. Commonly, such containers include a generally rectangular receptacle portion and a cover which is hingedly connected thereto and which has a skirt which depends downwardly from the top edge of the cover to extend over a portion of the top of the receptacle. The skirt is often initially sealed to the receptacle in some way so that the user has to break the seal upon opening. Various of these cartons have included locking tabs or latches which allow the opened cover to be latched back onto the receptacle after reclosure. Examples of reclosable cartons are shown in U.S. Pat. No. 4,150,748, U.S. Pat. No. Re. 26,185 and U.S. Pat. No. Re. 26,471.

Typical problems experienced by cartons of these types are excessive bowing of the front of the carton, after opening, and, conversely, difficult closing and opening of cartons which are filled with a hard product such as ice cream where the latching reclosure of the lid depends on the bowing of the carton. An additional problem is particularly encountered in the filling of flip-top cartons with soft ice cream. Usually, the carton is partially erected and sealed such that only one side is left open, with the liquid ice cream being introduced into the carton from this side. Because the top panel of the cover portion of the carton is not sealed to the top edges which define the open top of the receptacle, liquid ice cream can sometimes leak through the joints between the cover and the receptacle and appear on the outside of the package, detracting from the appearance and sanitation of the completed package.

SUMMARY OF THE INVENTION

The carton of the invention includes a receptacle portion having a substantially rectangular top opening and a cover portion which is hingedly connected to the receptacle. The receptacle portion includes front, bottom, and rear panels hingedly connected together, and a pair of end panels hingedly connected to the side edges of the front panel and extending rearwardly therefrom. Connecting tabs are preferably hingedly connected by cut lines of weakness to the top edges of the end panels at positions adjacent the connection of the end panels to the front panel. These tabs are folded over to lie flat against the end panels. Additional receptacle end flaps and rear receptacle flaps may be provided on the bottom and rear panels which are folded up and secured to lie over the end panels which extend from the front panel.

The cover portion includes a top panel which is hingedly connected to the top edge of the rear panel and a front cover flap hingedly connected to the front edge of the top panel and extending downwardly to cover a top portion of the front panel of the receptacle. The front flap preferably has a pair of end tabs hingedly connected thereto at the side edges of the front flap. In the sealed carton, the end tabs lie over and are secured to a respective one of the connecting tabs which have been laid over the receptacle end panels. The cover may also include a pair of side cover flaps which are hingedly connected to the side edges of the top panel and depend downwardly therefrom to be secured to the surface of the end tabs. An extension flap is hingedly connected to the bottom edge of the front flap and is folded over to lie between the front flap and the front panel. This extension flap is secured to the front panel entirely along its length. A central portion of the extension flap is hingedly connected to the front flap by a hinge line and is bounded by a line of weakness to define a locking tab which is not secured to the underlying front panel. The reminder of the extension flap is hingedly connected to the front flap by a line of weakness so that, upon opening, the extension flap will part from the front flap and will remain adhered to the front panel, with the locking tab portion thereof breaking away and remaining hingedly attached to the front flap. The relatively small locking tab can then hinge backwardly on reclosure into engagement with the edges of the void left in the extension flap so as to latch the cover into a locked reclosed position.

In a preferred embodiment adapted to contain ice cream, the carton also includes a relatively narrow reinforcing flap hingedly connected to the top edge of the front panel and which extends rearwardly therefrom for a short distance under the top panel. The reinforcing flap seals up the front top edge of the carton during filling of ice cream so that liquid ice cream does not leak between the cover and the receptacle at this juncture. In addition, the reinforcing flap acts as a brace at a right angle to the front panel to additionally resist bowing of the front panel.

It is thus seen that until opening, the package formed is securely sealed to hold the contents within the package. Upon opening, the splitting of the carton along the cut lines of weakness allows the cover portion to be parted from the receptacle portion at the lines of weakness in the extension flap and along the lines of weakness by which the connecting tabs are attached to the top edges of the end panels.

The carton of the invention is especially adapted to be formed from an easily machined and assembled unitary paperboard blank. The blank comprises a front receptacle panel, bottom receptacle panel, rear receptacle panel, top cover panel and front cover flap connected together by hinge lines. A centrally disposed locking tab is defined in an extension flap between a hinge line which hingedly connects the locking tab to the front cover flap, and lines of weakness cut into the extension flap to bound the area of the locking tab. The remainder of the extension flap is connected to the front cover flap by cut lines of weakness Rectangular end panels extend outwardly from hinged connections to the sides of the front panel, and connecting tabs are connected to each receptacle end panel at a position adjacent the hinged connection of the end panel to the front panel by cut lines of weakness. A relatively narrow reinforcing flap is hingedly attached to the front edge of the front panel. Receptacle end flaps are hingedly attached to the sides of the bottom panel; rear receptacle flaps are hingedly attached to the sides of the rear panel; and side cover flaps are hingedly attached to the sides of the top panel. End tabs are hingedly attached to the sides of the front cover flap, and are preferably sized and shaped to substantially correspond to the size and shape of the connecting tabs so as to register with the same when the blank is folded to form the carton. Lines of adhesive are preferably formed prior to folding of the carton adjacent the edges of the receptacle end flaps, adjacent one edge of the side cover flaps, in a strip along the end tabs, and, on the opposite side of the blank, along a portion of the extension flap lying outwardly of the bounded area defining the locking tab.

Further objects, features, and advantages of the invention will be apparent from the following detailed description taken in conjunction with the accompanying drawings showing a preferred embodiment of a reclosable flip-top carton and a blank therefor.

DESCRIPTION OF THE PREFERRED EMBODIMENT

Figure 1:
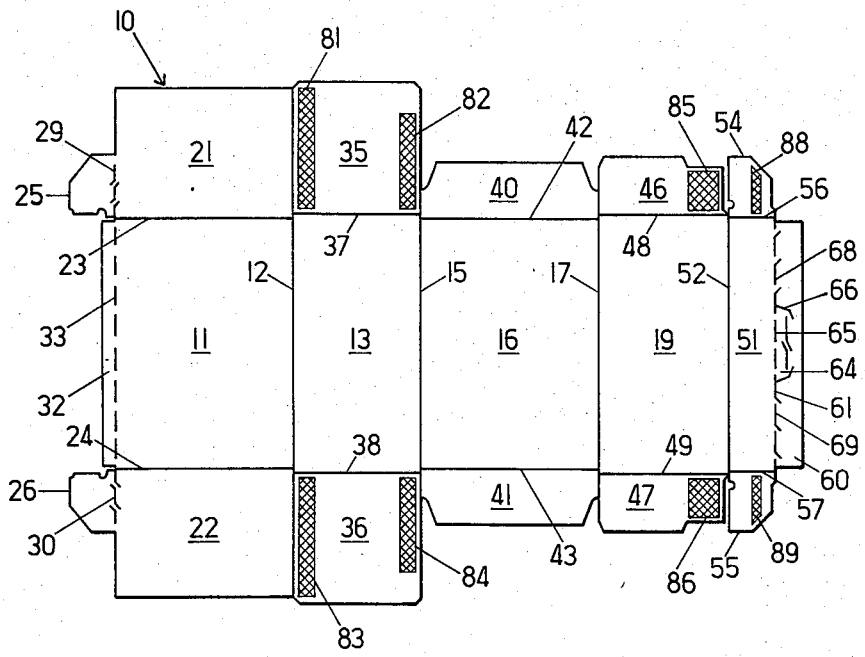
FIG. 1 is a plan view of a blank in accordance with the present invention.

With particular reference to the drawings, in which like numerals refer to like parts in each view, a preferred embodiment of a carton blank embodying the invention is shown generally at 10 in FIG. 1. The blank is integrally formed and includes a rectangular front receptacle panel 11 hingedly connected by a hinge line 12 at its bottom edge to the front edge of a bottom receptacle panel 13, which is itself hingedly connected at its back edge by a hinge line 15 to the bottom edge of a rear receptacle panel 16. The rear panel is also hingedly connected at its top edge along a hinge line 17 to the back edge of a top cover panel 19. These four panels provide the front, bottom, back and top walls of the erected carton.

Receptacle end panels 21 and 22 are connected at their front edges by respective hinge lines 23 and 24 to the side edges of the front panel 11. The end panels 21 and 22 are substantially rectangular and have connecting tabs 25 and 26 hingedly connected respectively to the top edges of the end panels 21 and 22 by cut lines of weakness 29 and 30. The connecting tabs 25 and 26 are positioned on their end panels just adjacent the hinge lines 23 and 24. The connections 29 and 30 are preferably cut as shown to provide a hinged connection between the end panels and connecting tabs which will allow these tabs to be torn away easily from the end panels upon opening of the carton for the reasons explained further below.

A relatively narrow reinforcing flap 32 is connected by an intermittantly cut scored hinge line 33 to the top edge of the front panel 11. The width of the reinforcing flap 32 is substantially less than that of the top cover panel, preferably being in the range of $\frac{1}{4}$ to $\frac{1}{2}$ inch wide for a typical use such as on a $\frac{1}{2}$ gallon ice cream carton. The cut scored hinge 33 is preferred since it allows the reinforcing flap to rotate easily about the hinge on closing of the carton.

A pair of receptacle end flaps 35 and 36 are hingedly attached by hinge lines 37 and 38 respectively to the side edges of the bottom panel. The end flaps 35 and 36 are as wide as the bottom panel but extend outwardly a distance which corresponds to only a substantial part of the height of the carton as erected. Rear receptacle flaps 40 and 41 are hingedly attached by hinge lines 42 and 43 respectively to the side edges of the rear panel 16. Side cover flaps 46 and 47 are hingedly attached respectively by hinge lines 48 and 49 to the side edges of the top panel 19. The receptacle end panels and the various flaps are provided to close the ends of the erected carton.

A front cover flap 51 is hingedly attached at its top edge by a hinge line 52 to the front edge of the top panel 19. The front cover flap 51 is rectangular and substantially elongated, and has a pair of end tabs 54 and 55 which are respectively hingedly connected by hinge lines 56 and 57 to the side edges of the front cover flap. An extension flap 60 is hingedly connected to the front cover flap 51 along its bottom edge 61. A locking tab 64 is centrally disposed within the extension flap 60 between a hinge line 65 lying along the bottom edge 61 and a cut line of weakness 66 cut into the extension flap. The hinge line 65 provides a firm hinged connected between the locking tab 64 and the front cover flap 51. The remainder of the extension flap 60 is hingedly connected to the front cover flap along the bottom edge 61 by cut lines of weakness 68 and 69.

Erection of the blank 10 into a completed carton is best shown with reference to the sequence of views of FIGS. 1–5. As shown in FIG. 1, heat activated hot melt adhesive is applied before erection to the inner side of the blank, whose face is shown in FIG. 1, at areas 81, 82, 83, and 84 which lie substantially adjacent the sides of the receptacle end flaps 35 and 36. Patches of hot melt pre-applied adhesive are provided at 85 on the side cover flap 46 and at 86 on the side cover flap 47. A strip of adhesive is also applied at 88 to the end tab 54 and at 89 to the end tab 55, although it is preferred that these areas of adhesive be applied at the time of erection of the carton.

Figure 2:
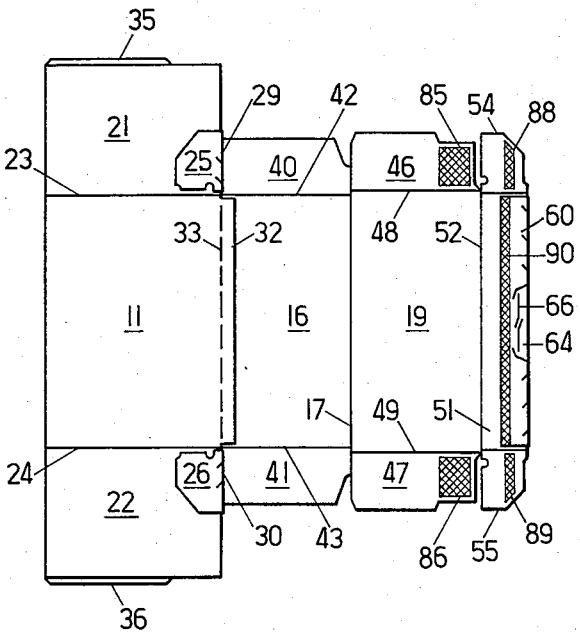
FIG. 2 is a plan view of the blank of FIG. 1 showing portions of the carton in folded relation after an initial folding step.

The initial step in folding and erecting the carton of the invention is shown in FIG. 2, in which the front panel 11 has been folded to lie over and substantially coplanar with the bottom panel 13 and a portion of the rear panel 16. The connecting tabs 25 and 26 are folded over backward to lie flat upon the exposed sides of the receptacle end panels 21 and 22. At the other end of the blank, the extension flap 60 is folded over to lie flat upon the inner side of the front cover flap 51. As shown in FIG. 2, a strip of preferably water based adhesive 90 is laid on the exposed surface of the extension flap 60 along its length at a position preferably substantially co-linear with the position of the strips of adhesive 88 and 89 on the end tabs 54 and 55. The adhesive on these flaps may be applied at the same time by a single pass of an adhesive applicator after the extension flap is folded over. The strip of adhesive 90 is formed along the length of the extension flap 60 at a position outside of the cut weakness line 66 so that no adhesive is applied to the area of the locking tab 64.

Figure 3:
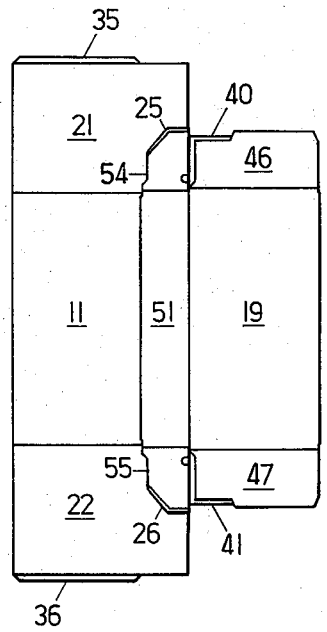
FIG. 3 is a plan view of the blank of FIG. 1 with the portion shown thereof in a further folded relationship.

A further step in the erection of the carton is shown in FIG. 3, wherein the top panel 19 and the front cover flap 51 have been folded over to lie coplanar with and over the rear panel 16 and a portion of the front panel 11. The end tabs 54 and 55 are glued down to the underlying connecting tabs 25 and 26 respectively and the extension flap 60 is glued at the area of the adhesive 90 to the face of the front panel 11. It is highly preferred that the end tabs 54 and 55 are substantially the same in size and shape as the underlying connecting tabs 25 and 26 so as to substantially register therewith.

Figure 4:
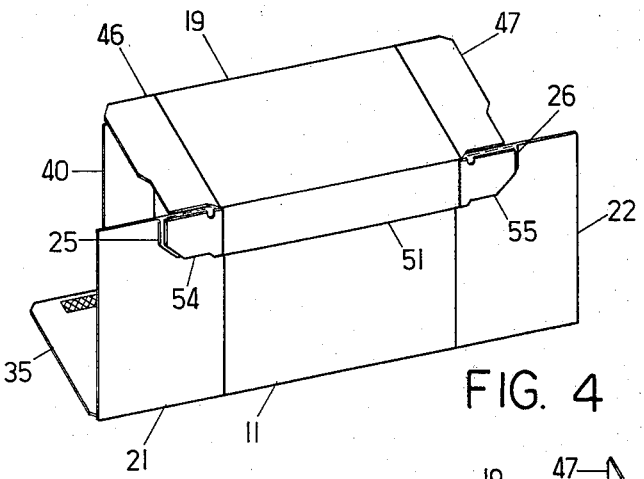
FIG. 4 is a perspective view of the blank in partially erected relationship.
Figure 5:
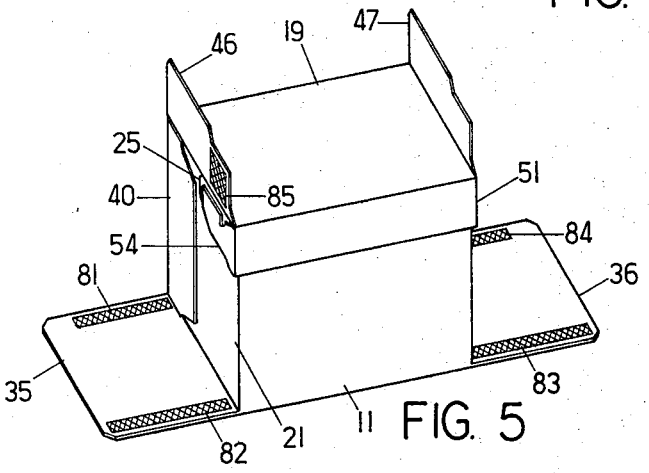
FIG. 5 is a perspective view of a carton erected from the blank of FIG. 1 showing the ends of the carton partially closed.
Figure 6:
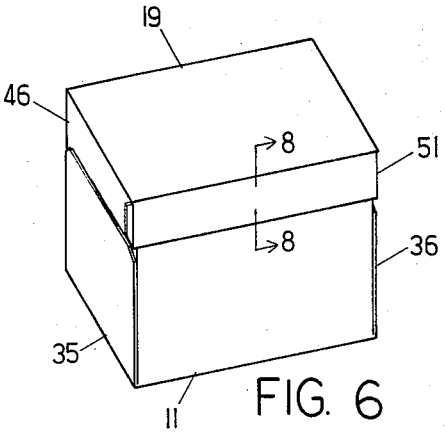
FIG. 6 is a perspective view of a carton in accordance with the invention having been erected from a blank as shown in FIG. 1.

In the view of FIG. 4, the blank as shown in FIG. 3 is pushed upward so that the front panel 11 and rear panel 16 are vertical and the bottom panel 13 and top panel 19 are horizontal. To complete closure of the carton, one of the receptacle end panels, such as the end panel 21, is pushed inwardly to form a side wall of the carton, and the rear receptacle flap 40 is pushed in to lie over and coplanar with the end panel 21, as shown in FIG. 5. The side cover flap 46 is folded down to bring the adhesive patch 85 into contact with the end tab 54, and the receptacle end flap 35 with the adhesive strips 81 and 82 may then be folded up to make contact with the flap 40 and the end panel 21 to complete sealing of the end of the package as shown in FIG. 6. With one end sealed, the package may then be set on the sealed end and the product may be inserted into the package through the other open end, such as by pouring semi-liquid ice cream into the package until it fills to the end. The open end of the package may then be closed in the same sequence as described above, with partial closure of the opposite end being shown for illustrative purposes in FIG. 5. It should be appreciated that this end would remain open until the first end was completely sealed and the product was inserted into the carton.

In the fully erected carton, the receptacle portion includes the front receptacle panel 11, the bottom receptacle panel 13 extending rearwardly from connection with the bottom edge of the front panel, the rear receptacle panel 16 connected to the rear edge of the bottom panel and extending upwardly therefrom, and the pair of receptacle end panels 21 and 22 connected at their front edges to the side edges of the front panel and extending rearwardly therefrom with their top edges at the top edges of the front panel. The rear receptacle flaps 40 and 41 are connected to the side edges of the rear panel 16 and lie over and coplanar with the receptacle end panels. The receptacle end flaps 35 and 36 are connected to the side edges of the bottom panel and lie over and are secured to the rear receptacle flaps and receptacle end panels. The reinforcing panel 32 is hingedly connected to the top edge of the front panel along its length and extends rearwardly therefrom.

The cover portion of the erected carton includes the top cover panel 19 which is hingedly connected to the top edge of the rear panel 16 and extends frontwardly therefrom and the front cover flap connected to the front edge of the top panel and extendly downwardly therefrom over a portion of the front panel. The extension flap 60 is connected to the bottom edge of the front cover flap and lies between the front cover flap and the front panel and is secured to the front panel along its length to provide a front connection between the cover portion and the receptacle portion. The connecting tabs 25 and 26 are connected by cut lines of weakness to the top edges of the receptacle end panels and lie against the respective end panel to which each is connected. The end tabs 54 and 55 are connected to the side edges of the front cover flap and extend rearwardly therefrom to lie over and be secured to the connecting tabs. The side cover flaps 46 and 47 are connected to the side edges of the top panel and depend downwardly therefrom over the end tabs, connecting tabs and end panels and are secured to the end tabs, thereby providing an initial connection between the receptacle and cover portions at the sides of the carton.

Figure 8:
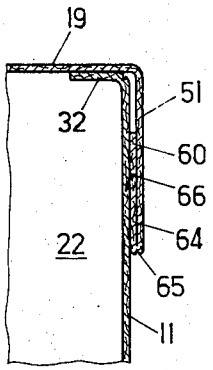
FIG. 8 is a partial cross-sectional view taken along the line 8—8 of FIG. 6.

A cross-sectional view through the front top edge of the carton is shown in FIG. 8. As seen therein, the reinforcing flap 32 extends partially over the top of the carton in contact with the top panel 19. This flap thus prevents liquid product being inserted in one end of the carton from leaking through the joint that would exist at the top edge of the front panel 11 at which it meets the top panel 19. As indicated above, the extension flap 60 is adhered to the front face of the front panel 11 above the cut scored line of weakness 66, whereas the opening tab portion 64 of the extension flap is not sealed to the underlying front panel. A user can open the carton by inserting a finger between the locking tab 64 and the face of the front panel 11 and passing the finger to each end of the carton to break the connection at the lines of weakness 68 and 69. As the user further pulls the front cover flap and the remainder of the cover away from the receptacle portion, the connecting tabs 25 and 26 will be split away from the receptacle end panels 21 and 22 at the lines of weakness 29 and 30. The connecting tabs will remain adhered to the end tabs 54 and 55, which themselves are adhered to the front cover flaps 46 and 47, and will remain hingedly connected to the front cover flap 51. The locking tab 64 will initially remain connected at the line of weakness 66 as the cover portion is open and will toggle outwardly and upwardly about the line 66 and its hinge line 65. The relatively short length of the tab 64 allows it to accomplish this toggle action easily, in contrast to locking members which extend the width of a carton. Further opening of the cover causes the connection at the line of weakness 66 to be broken. The cover portion is thus free to rotate about the hinge line 17 to either open or close the rectangular top opening of the receptacle portion as defined by the front panel 11, bottom panel 13, rear panel 16, and receptacle end panels 21 and 22. Reinforcement for closure of the end panels is provided by the end flaps 35 and 36 and the rear receptacle flaps 40 and 41.

Figure 7:
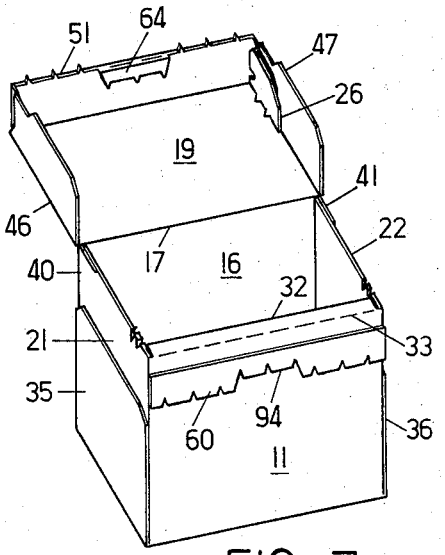
FIG. 7 is a perspective view of an opened carton in accordance with the invention.

The view of FIG. 7 shows the manner in which the locking tab 64 is torn away from the underlying extension flap 60, leaving a void 94 in the extension flap where the opening tab was located. As the cover portion is closed, the locking tab 64 is free to hinge inwardly so that it does not interfere with closing. As the cover is brought to a fully closed position, the locking tab tends to rotate inwardly about the hinge line 65 so that the top edges of the tab can engage the edges of the void 94 in the extension flap 60. Because of the small size of the tab 64, it can be toggled out of its locked position upon reopening of the cover with only a slight pushing out of the center of the front cover flap. This is again in contrast to typical flip lock closures wherein the locking member generally extends across the length of the carton and is difficult to disengage. Bowing of the front panel is resisted by the reinforcing flap 32 which, as seen in the views of FIGS. 7 and 8, extends inwardly perpendicular to the panel 11 to provide perpendicular brace reinforcement to the top edge of the front panel. The flap 32 thus provides reinforcement without adding substantial weight or bulk to the carton. Because the flap 32 is hingedly connected at the hinge line 33 to the front panel, it will be rotated up when a user scoops ice cream out of the carton and comes into contact with the flap 32, so that it does not interfere with access to the contents of the carton. The presence of the portion of extension flap 60 remaining adhered to the front face of the carton also provides reinforcement to the front panel 11 and resistance to bowing.

It is understood that the invention is not confined to the particular construction and arrangement of parts herein illustrated and described, but embraces all such modified forms thereof as come within the scope of the following claims.

I claim:

1. A carton having a cover portion which is hingedly reclosable over a receptacle portion, comprising:

(a) a front receptacle panel having top, bottom and side edges;

(b) a pair of receptacle end panels connected at their front edges to the side edges of said front panel and extending rearwardly therefrom with their top edges at the top edge of said front panel;

(c) a bottom receptacle panel having front, rear, and side edges and being connected at its front edge to the bottom edge of said front panel and extending rearwardly therefrom;

(d) a rear receptacle panel having top, bottom and side edges and being connected at its bottom edge to the rear edge of said bottom panel and extending upwardly therefrom;

(e) a relatively narrow reinforcing flap hingedly connected to the top edge of said front panel along the length thereof and extending rearwardly therefrom;

(f) a top cover panel having front, rear, and side edges and being hingedly connected at its rear edge to the top edge of said rear panel and extending frontwardly therefrom;

(g) a front cover flap having top, bottom, and side edges and being connected at its top edge to the front edge of said top panel and extending downwardly therefrom over a portion of said front panel; and (h) an extension flap connected to the bottom edge of said front cover flap and lying between said front cover flap and said front panel and being secured to said front panel along its length, a centrally disposed portion of said extension flap being connected to said front flap by a hinge line and being bounded by a cut line of weakness in said extension flap to define a locking tab which is not secured to said front panel, the remainder of said extension flap being connected to said front cover flap by a cut line of weakness.

2. A carton having a cover portion which is hingedly reclosable over a receptacle portion, comprising:

(a) a front receptacle panel having top, bottom and side edges;

(b) a pair of receptacle end panels connected at their front edges to the side edges of said front panel and extending rearwardly therefrom with their top edges at the top edge of said front panel;

(c) a bottom receptable panel having front, rear, and side edges and being connected at its front edge to the bottom edge of said front panel and extending rearwardly therefrom;

(d) a rear receptacle panel having top, bottom and side edges and being connected at its bottom edge to the rear edge of said bottom panel and extending upwardly therefrom;

(e) a relatively narrow reinforcing flap hingedly connected to the top edge of said front panel along the length thereof and extending rearwardly therefrom;

(f) a top cover panel having front, rear, and side edges and being hingedly connected at its rear edge to the top edge of said rear panel and extending frontwardly therefrom;

(g) a front cover flap having top, bottom, and side edges and being connected at its top edge to the front edge of said top panel and extending downwardly therefrom over a portion of said front panel;

(h) a pair of connecting tabs connected by cut lines of weakness to the top edges of said receptacle end panels, each said connecting tab being connected to its respective end panel at a position adjacent to the connection of the respective end panel to said front panel and lying against said receptacle end panels; and (i) a pair of end tabs connected to the side edges of said front flap and extending rearwardly therefrom to lie over and be secured to said connecting tabs.

3. A carton having a cover portion which is hingedly reclosable over a receptacle portion, comprising:

(a) a front receptacle panel having top, bottom and side edges;

(b) a pair of receptacle end panels connected at their front edges to the side edges of said front panel and extending rearwardly therefrom with their top edges at the top edge of said front panel;

(c) a bottom receptacle panel having front, rear, and side edges and being connected at its front edge to the bottom edge of said front panel and extending rearwardly therefrom;

(d) a rear receptacle panel having top, bottom and side edges and being connected at its bottom edge to the rear edge of said bottom panel and extending upwardly therefrom;

(e) a top cover being having front, rear, and side edges and being hingedly connected at its rear edge to the top edge of said rear panel and extending frontwardly therefrom;

(f) a front cover flap having top, bottom, and side edges and being connected at its top edge to the front edge of said top panel and extending downwardly therefrom over a portion of said front panel; and (g) an extension flap connected to the bottom edge of said front cover flap and lying between said front cover flap and said front panel and being secured to said front panel along its length, a centrally disposed portion of said extension flap being connected to said front flap by a hinge line and being bounded by a cut line of weakness in said extension flap to define a locking tab which is not secured to said front panel, the remainder of said extension flap being connected to said front cover flap by a cut line of weakness.

4. The carton of claim 3 including a relatively narrow reinforcing flap hingedly connected to the top edge of said front panel along the length thereof and extending rearwardly therefrom.

5. The carton of claim 3 including:

a pair of connecting tabs connected by cut lines of weakness to the top edges of said receptacle end panels, each said connecting tab being connected to its respective end panel at a position adjacent to the connection of the respective end panel to said front panel and lying against said receptacle end panels, and a pair of end tabs connected to the side edges of said front flap and extending rearwardly therefrom to lie over and be secured to said connecting tabs.

6. The carton of claim 5 or 2 including a pair of side cover flaps connected to the side edges of said top panel and depending downwardly therefrom over said end tabs, connecting tabs and end panels, and being secured to said end tabs.

7. The carton of claim 6 including a pair of rear receptable flaps connected to the side edges of said rear panel which lie over and coplanar with said receptacle end panels.

8. The carton of claim 7 including a pair of receptacle end flaps connected to the side edges of said bottom panel which lie over and are secured to said rear receptacle flaps and said receptacle end panels.

9. A unitary carton blank for forming a carton having a cover portion hingedly reclosable over a receptacle portion, said blank comprising:

(a) a front receptacle panel having top, bottom and side edges;

(b) a rear receptacle panel having top, bottom and side edges;

(c) a bottom receptacle panel having front, rear and side edges and being hingedly connected at its front edge to the bottom edge of said front panel and at its rear edge to the bottom edge of said rear panel;

(d) a top cover panel having front, rear and side edges and being hingedly connected at its rear edge to the top edge of said rear panel;

(e) a front cover flap having top, bottom, and side edges and being hingedly connected at its top edge to the front edge of said top panel;

(f) an extension flap hingedly connected to the bottom edge of said front cover flap, a centrally disposed portion of said extension flap being connected to said front cover flap by a hinge line and being bounded by a cut line of weakness in said extension flap to define a locking tab, the remainder of said extension flap being connected to said front cover flap by a cut line of weakness;

(g) a relatively narrow reinforcing flap hingedly connected to the top edge of said front panel; and (h) a pair of receptacle end panels hingedly connected at front edges to the side edges of said front panel.

10. The blank of claim 9 further including:

a pair of receptacle end flaps hingedly connected to the side edges of said bottom panel;

a pair of rear receptacle flaps hingedly connected to the side edges of said rear panel; and a pair of side cover flaps hingedly connected to the side edges of said top panel.

11. The blank of claim 9 further including a pair of connecting tabs hingedly connected to top edges of said receptacle end panels by cut lines of weakness at positions adjacent the hinged connections of said receptacle end panels to said front panel, and a pair of end tabs hingedly connected to the side edges of said front cover flap.

12. The blank of claim 9 wherein an adhesive is applied to one side of the blank on said receptacle end flaps and side cover flaps, and along the length of said extension flap on the opposite side of the blank at a position not covering the area of said extension flap defining the locking tab.

* * * * *